United States Patent [19]

Stolley

[11] 4,101,040

[45] Jul. 18, 1978

[54] VEHICLE FOR TRANSPORTING PALLETIZED LOADS

[75] Inventor: Ronald M. Stolley, Lincoln, Nebr.

[73] Assignee: Outboard Marine Corporation, Waukegan, Ill.

[21] Appl. No.: 796,804

[22] Filed: May 13, 1977

[51] Int. Cl.[2] ..... E02F 3/00

[52] U.S. Cl. ..... 214/131 R; 214/390

[58] Field of Search ..... 214/390, 130 R, 130 A, 214/130 B, 130 C, 766, 778, 78, 79, 131 R

[56] References Cited

U.S. PATENT DOCUMENTS

| | | | |
|---|---|---|---|
| 2,397,046 | 3/1946 | Richey | 214/131 X |
| 2,660,322 | 11/1953 | Richey | 214/131 |
| 2,714,460 | 8/1955 | Cook | 214/766 |
| 3,101,153 | 8/1963 | Verdery, Jr. | 214/390 X |
| 3,762,590 | 10/1973 | Grooss | 214/130 C X |

*Primary Examiner*—Albert J. Makay
*Attorney, Agent, or Firm*—Michael, Best & Friedrich

[57] ABSTRACT

Disclosed herein is a vehicle which is particularly adaptable for transporting palletized loads from one location to another and which includes a chassis, a steering and traction unit mounted on the rear portion of the chassis, and a pair of laterally spaced, generally horizontal side frame members which extend from the front end of the chassis and have a free end. The side frame members are sufficiently spaced apart to straddle the load to be transported and each is supported by a ground-engaging front wheel located near the free end thereof. A load-lifting frame, including a pair of laterally spaced forks which can be inserted into a pallet, is disposed between the side frame members and is pivotally connected to the front end of the chassis by a linkage arrangement which is arranged so that the load-lifting frame is automatically tilted rearwardly as the load-lifting frame is moved from a lowered position to a raised or transporting position by a lift mechanism connected between the chassis and the load-lifting frame.

4 Claims, 2 Drawing Figures

VEHICLE FOR TRANSPORTING PALLETIZED LOADS

BACKGROUND OF THE INVENTION

The invention generally relates to vehicles for transporting palletized loads from one location to another.

When it is desired to move palletized loads from one location to another without stacking, forklift trucks are normally used. Conventional forklift trucks including an elevator type lift carriage have certain disadvantages which limit their use for this purpose. For instance, they often are too heavy to operate on soft surfaces, have relatively low ground clearance, are incapable of transporting loads at higher speeds desired for longer distance movement, and their initial purchase price makes them economically unfeasible for users who do not need their normal pay load or stacking capabilities.

Consequently, a need exists for an inexpensive, lightweight vehicle which is capable of transporting palletized loads in areas where conventional forklift trucks are at a disadvantage or are being used for purposes requiring less than operating capabilities.

SUMMARY OF THE INVENTION

The invention provides a vehicle for transporting palletized loads including a chassis, a pair of laterally spaced, generally horizontal side frame members which extend forwardly from the forward end of the chassis, which have a free end portion, and which are sufficiently spaced apart to straddle the load to be transported, a ground-engaging rear wheel mounted on the rear portion of and partially supporting the chassis, a ground-engaging wheel mounted on each of the side frame members near the free end and supporting the side frame members in spaced relationship to the ground, a load-lifting frame adapted to lift and carry a palletized load disposed between the side frame members, means connecting the load-lifting frame to the front end of the chassis for movement relative to the chassis and to the side frame members between a lowered position for picking up the load and a raised position to lift the load for transporting to another location, and lift means connected between the chassis and the load-lifting frame for moving the load-lifting frame between the lowered and raised positions.

In one embodiment, the load lifting frame is pivotally connected to the chassis by a linkage arrangement having a geometry such that the load-lifting frame is automatically tilted rearwardly relative to the side frame members as it is moved from the lowered position toward the raised position by the lift means.

In one embodiment, the load-lifting frame has a rear portion including a generally upright member, the lift means is connected between the chassis and the upright frame member, and the linkage arrangement includes a pair of vertically spaced upper and lower rigid links, each having one end pivotally connected to the chassis and the other end pivotally connected to the upright member with the distance between the pivotal connections of the upper link being less than the distance between the pivotal connections of the lower link.

In one embodiment, the lift means includes a double-acting, fluid-actuated ram having one end pivotally connected to one of the chassis and the upright member and a piston rod connected to the other one of the chassis and the upright member.

One of the principal features of the invention is the provision of a lightweight, low-cost vehicle which is capable of transporting palletized loads from one location to another at relatively high speeds.

Another of the principal features of the invention is the provision of such a vehicle including a load-lifting frame which is adapted to lift and carry a palletized load and which automatically tilts rearwardly when moved from a lowered position to a raised or transporting position.

Another of the principal features of the invention is the provision of a vehicle for transporting palletized loads including a pair of forwardly extending side frame members which are sufficiently spaced apart to straddle the load to be transported and each of which is supported by a front wheel located near the free end thereof and a load-lifting frame disposed between the side frame members and connected to the front end of the vehicle chassis for lifting and carrying the load in a manner whereby the load is largely supported by the front wheels.

Other features and advantages of the embodiments of the invention will become apparent to those skilled in the art upon reviewing the following detailed description, the drawing, and the appended claims.

Figure 1:
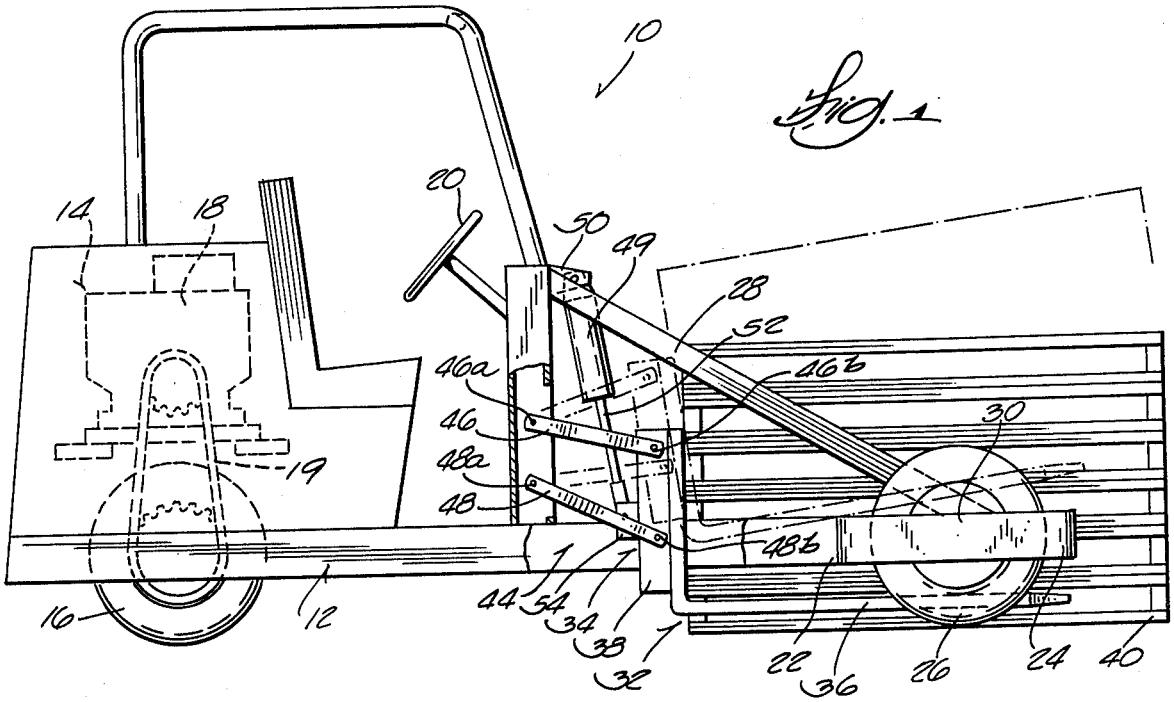
FIG. 1 is a partially broken away and partially diagrammatic side elevation view of a vehicle for transporting palletized loads and embodying various of the features of the invention.
Figure 2:
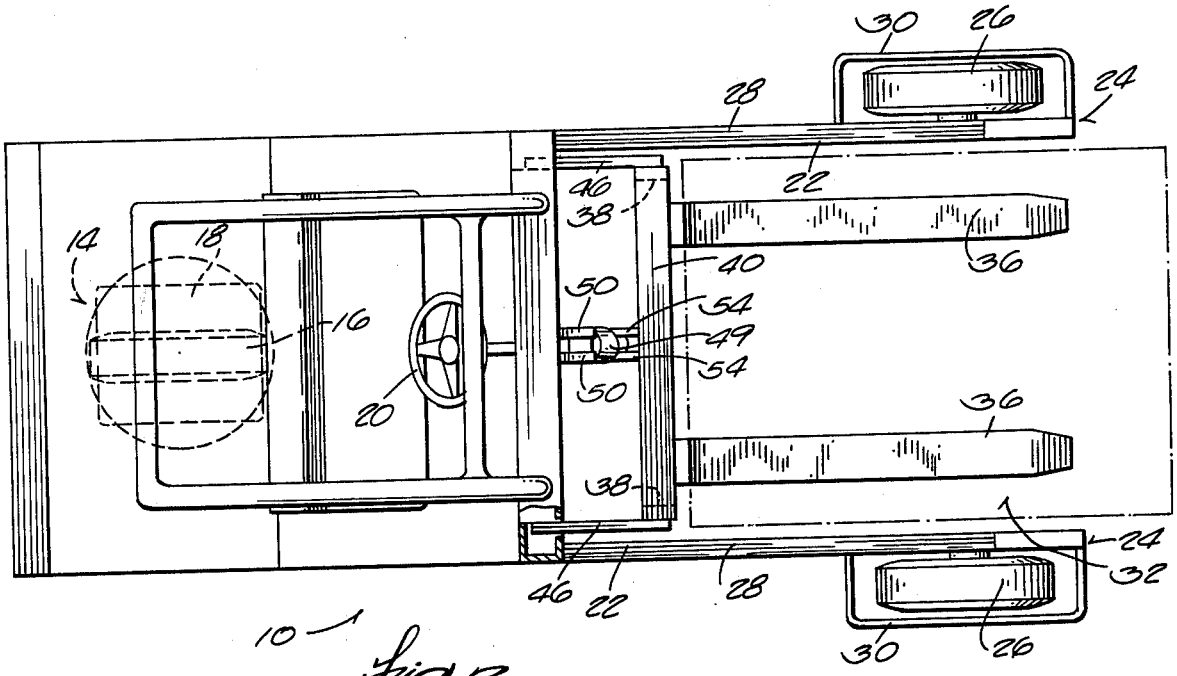
FIG. 2 is a top plan view of the vehicle of FIG. 1.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENTS

Illustrated in the drawing is a vehicle 10 which is particularly adaptable for transporting palletized loads from one location to another and which embodies various features of the invention. The vehicle 10 includes a chassis 12 and a combined steering and traction unit 14 which is supported from the rear portion of the chassis 12 for steering rotation and drive relative to the chassis.

The steering and traction unit 14 is of conventional construction and its specific arrangement does not form part of the invention. Accordingly, a detailed illustration and description of same is not necessary for a full understanding of the invention. In general, the steering and traction unit 14 includes one or more ground-engaging, rear wheels 16 (one shown) which partially support the chassis 12 and serve as a traction wheel for moving the vehicle. Supported on the chassis 12 is a prime mover 18 (illustrated diagrammatically) such as an electric motor, a hydraulic motor or an internal combustion engine, which is drivingly connected to the traction wheel 16 through a suitable drive train 19, such as a chain or the like, affording rotation of the wheel and traction unit 14 relative to the prime mover 18 during steering. Steering movement of the steering and traction unit 14 is accomplished by turning a steering wheel 20 rotatably mounted on the chassis 12 and operably connected to the steering and traction unit 14 by suitable means (not shown).

Extending forwardly from the front end of the chassis 12 is a pair of laterally spaced, generally horizontal rails or side frame members 22 which have a forward free end 24 and are sufficiently spaced apart to straddle a palletized load to be transported. Each of the side frame members 22 is supported for movement in spaced relationship to the ground by a ground-engaging front wheel 26 which is suitably rotatably mounted on the outer side of the frame member 22. A strut 28 connected between the chassis 12 and the forward end of each side frame 22 provides additional structural support for the side members 22.

The wheels 26 preferably are located near the forward ends 24 of the side frame members 22 so as to balance a load being transported by the vehicle 10 in the manner to be described. Partially surrounding each of the wheels 26 and suitably affixed to the respective side frame member 22 is a protective bumper 30.

Disposed between the side frame members 22 for carrying a palletized load is a load-lifting frame 32 including a generally vertical or upright frame structure 34 and a pair of transversely spaced legs or forks 36 affixed on and extending forwardly from the frame structure 34 in generally parallel relationship. The frame structure 34 includes a pair of transversely spaced upright members 38 which are connected together by a pair of vertically spaced cross members 40 (one shown). The forks 36 are arranged to permit their insertion into a pallet(s) 40 to be lifted and transported.

Means are provided for connecting the load-lifting frame 32 to the front end of the chassis 12 for movement of the load-lifting frame 32 relative to the chassis 12 and to the side frame members 22 between a first or lowered position generally adjacent the ground (shown by solid lines in FIG. 1) wherein the forks 36 can be inserted into a pallet 40 and a second or raised position (shown by dashed lines in FIG. 1) wherein the pallet 40 is sufficiently raised from the ground to permit relatively high speed movement thereof to another location. While various arrangements can be used, in the specific construction illustrated, such means comprises a linkage arrangement 44 including transversely spaced pairs of vertically spaced upper and lower rigid links 46 and 48 which extend between and are pivotally connected at their opposite ends to the front end of the chassis 10 and to respective upright members 38 of the frame structure 34.

In order to promote movement of the pallet towards the rearwardmost portion of the load-lifting frame 32 and to minimize any tendency of the pallet 40 to slip off the forks 36 during transportation, the geometry of the links 46 and 48 and their pivotal connections preferably is designed so that the load-lifting frame 32 is automatically tilted rearwardly as it is moved from the lowered position toward the raised position. In the specific construction illustrated, the upper and lower links 46 and 48 extend between the chassis 12 and the respective upright members 38 in a nonparallel relationship and the distance between the pivotal connections **46*a* and 46*b* of the upper links 46 is less than the distance between the pivotal connections 48*a* and 48*b* of the lower links 48. More particularly, each of the lower links 48 extend forwardly from its chassis pivotal connection 48*a* at an acute angle with respect to the ground greater than the angle of the upper links 46 when the load-lifting frame 32 is in the lowered position. In the illustrated construction, the automatic rearward tilting of the load-lifting frame is provided by locating the axes 46*a* and 48*a* in directly vertically spaced alignment and by locating the axes 46*b* and 48*b*** in directly vertically spaced alignment.

The load-lifting frame 32 is moved between the lowered and raised positions by a conventional power lift mechanism suitably connected between the chassis 10 and the load-lifting frame 32. In the specific construction illustrated, the lift mechanism includes a double-acting, hydraulic ram 49 having one end pivotally connected between a pair of ears 50 provided on the front end of the chassis 12 and a piston rod 52 pivotally connected between a pair of ears 54 provided on the lower portion of the frame structure 34. The piston rod 52 is extended to lower the load-lifting frame 32 and retracted to raise the load-lifting frame 32. If desired, the piston end of the ram 49 can be pivotally connected to the chassis 12 and the other end pivotally connected to the frame structure 34. Various other conventional lift mechanisms can be used, such as an electric or hydraulic motor-operated chain drive arrangement or the like.

From the above description, it can be seen that the vehicle provided by the invention, while capable of transporting reasonably heavy palletized loads from one location to another at relatively high speeds, can be of lightweight construction because the load is supported primarily by the front wheels 26 which can be located near or even forwardly of the center of gravity of the load, instead of being carried in a cantilevered manner as is the case with many conventional forklift trucks. This feature, along with other features such as the preferred illustrated and described simple linkage arrangement for connecting the load lift frame to the chassis, permits the vehicle to be fabricated at a cost substantially less than that for forklift trucks of conventional construction.

Various of the features of the invention are set forth in the following claims.

What is claimed is:

1. A vehicle for transporting palletized loads comprising a chassis having a rear end portion and a forward end portion, a pair of laterally spaced, generally horizontal side frame members extending forwardly from said forward end portion of said chassis, said side frame members having a free forward end and being sufficiently spaced apart to straddle the load to be transported, a ground-engaging rear wheel mounted on said rear end portion of and partially supporting said chassis, a ground-engaging wheel mounted on each of said side frame members near said free end thereof and supporting said side frame members in spaced relationship to the ground, a load-lifting frame adapted to lift and carry a palletized load disposed between said side frame members, a linkage arrangement connecting said load-lifting frame to said chassis for movement of said load-lifting frame relative to said chassis between a lowered position for picking up the load and a raised position to lift the load for transporting to another location, said linkage arrangement being automatically operative to tilt said load-lifting frame rearwardly relative to said chassis as said load-lifting frame is moved from the lowered position toward the raised position and including a pair of vertically spaced upper and lower rigid links, said upper link having a first end pivotally connected to said chassis about a first axis fixed relative to said chassis and said upper link and having a second end pivotally connected to said load-lifting frame about a second axis fixed relative to said load-lifting frame and said upper link, said lower link having a first end pivotally connected to said chassis about an axis fixed relative to said chassis and said lower link and located directly vertically below said first axis, said lower link also having a second end pivotally connected to said load-lifting frame about an axis fixed relative to said load-lifting frame and said lower link and located directly vertically below said second axis when said load-lifting frame is in the lowered position, the distance between the pivotal connections of said upper link being less than the distance between the pivotal connections of said lower link, and lift means connected between said chassis and said load-lifting frame for moving said load-lifting frame between the lowered and raised positions.

2. A vehicle according to claim 1 wherein said upper and lower links are pivotally mounted on said chassis at a location spaced rearwardly from said load-lifting frame and extending forwardly therefrom in nonparallel relationship when said load-lifting frame is in the lowered position, said lower link extending forwardly from its chassis pivotal connection at an acute angle with respect to the ground greater than the angle of said upper link.

3. A vehicle according to claim 1 wherein said lift means includes a double-acting fluid-actuated ram having one end pivotally connected to one of said chassis and said load-lifting frame and a piston rod pivotally connected to the other one of said chassis and said load-lifting frame.

4. A vehicle according to claim 1 including a steering and traction unit mounted on said rear portion of said chassis for steering said vehicle and including said rear wheel which serves as a traction wheel for moving said vehicle, and drive means supported from said chassis for driving said traction wheel.

* * * * *